United States Patent [19]

Bierlich

[11] 4,035,953

[45] July 19, 1977

[54] HINGE AND HINGE AND PIVOT ARRANGEMENT

[76] Inventor: Johannes Harald Bierlich, Oresundshoj 15, Charlottenlund, Denmark

[21] Appl. No.: 703,295

[22] Filed: July 7, 1976

[51] Int. Cl.[2] ..... E05D 15/52

[52] U.S. Cl. ..... 49/192

[58] Field of Search ..... 49/192, 193

[56] References Cited

U.S. PATENT DOCUMENTS

| | | | |
|---|---|---|---|
| 3,447,265 | 6/1969 | Weber | 49/192 |
| 3,667,162 | 6/1972 | Lalague | 49/192 |
| 3,802,124 | 4/1974 | Guerrini | 49/192 |
| 3,911,621 | 10/1975 | McHeffey | 49/192 |
| 3,994,093 | 11/1976 | Mayer et al. | 49/192 |

*Primary Examiner*—Philip C. Kannan
*Attorney, Agent, or Firm*—Brisebois & Kruger

[57] ABSTRACT

A hinge and pivot arrangement for a movable member such as a window sash, and a co-operating frame, comprises two hinges arranged at opposite ends of one member of the frame to permit the movable member to be hinged thereabout when an operating handle which moves an operating rod and carries a locking member is moved to a second position from a first position in which the locking member engages a striker plate on another member of the frame, opposite to the said one frame member, to secure the movable member to the frame against opening, and in a third position of the operating handle, the locking member is disengaged from the striker plate and a bolt co-operating with means for releasably connecting one of said hinges to the movable member disconnect the hinge from the movable member and a pin carried by the operating rod is engaged in the channel of a stay pivoted at one end to said another frame member to permit the movable member to tilt within the limit imposed by the stay relative to a further member of the frame which interconnects the said opposing frame members.

6 Claims, 10 Drawing Figures

Figure 2:
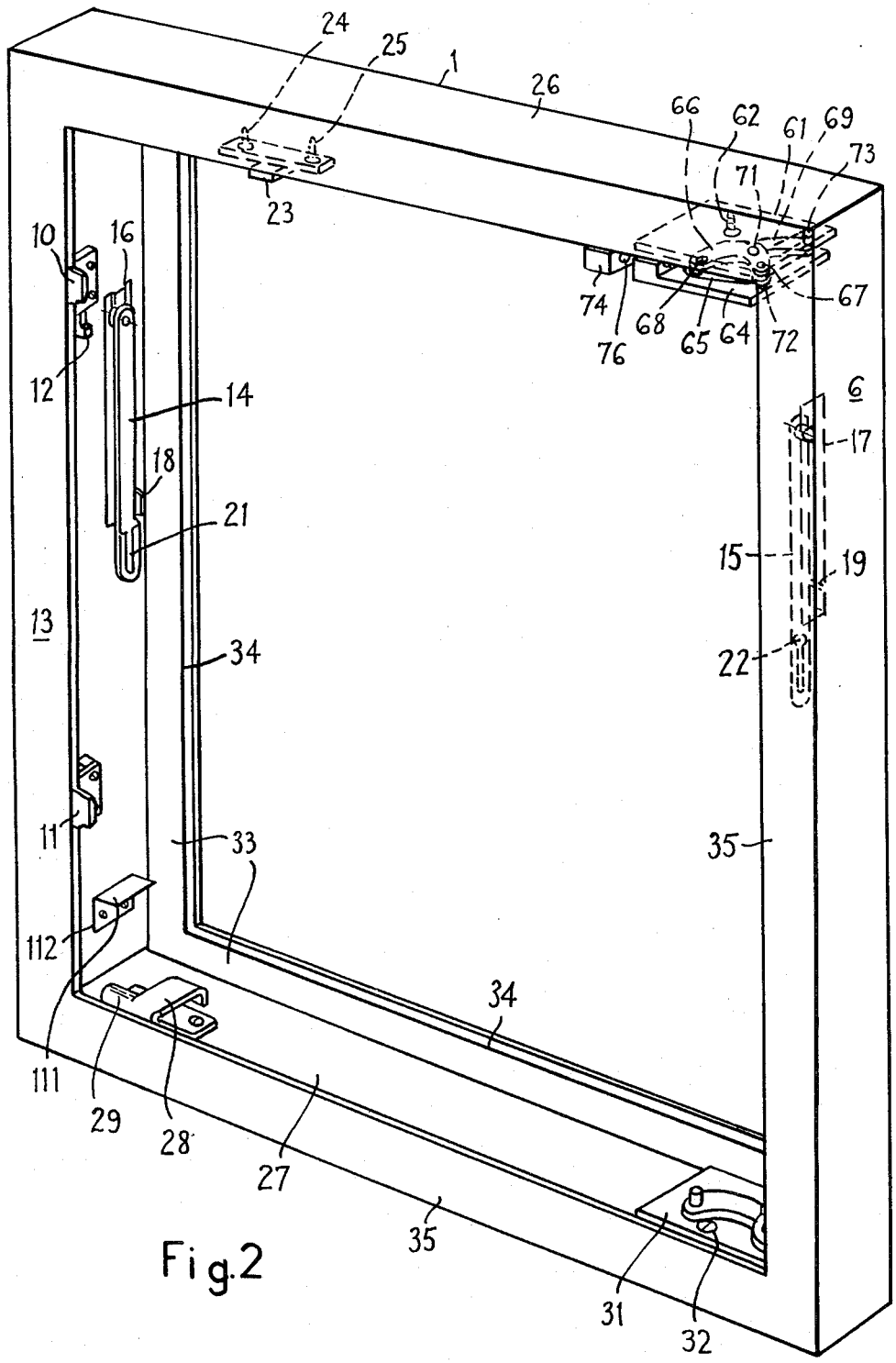

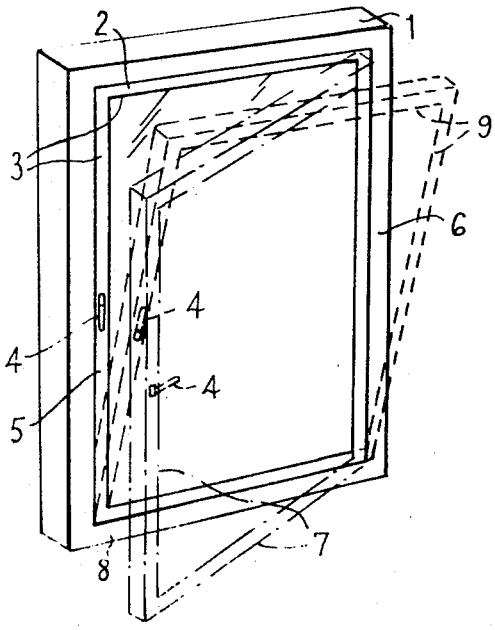
Fig.1
Fig.5
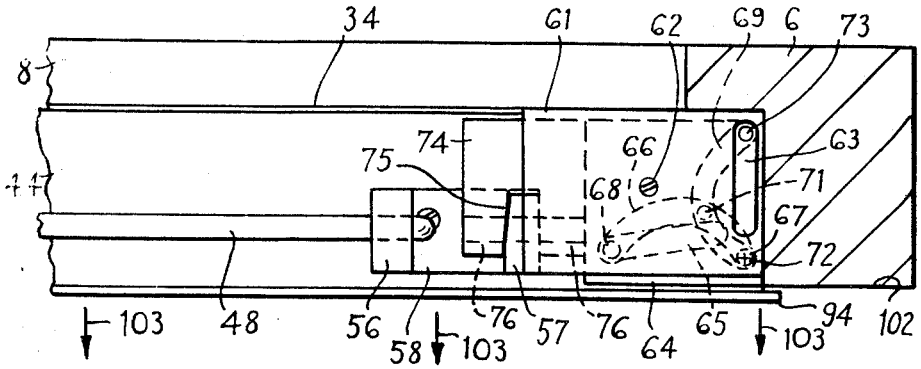
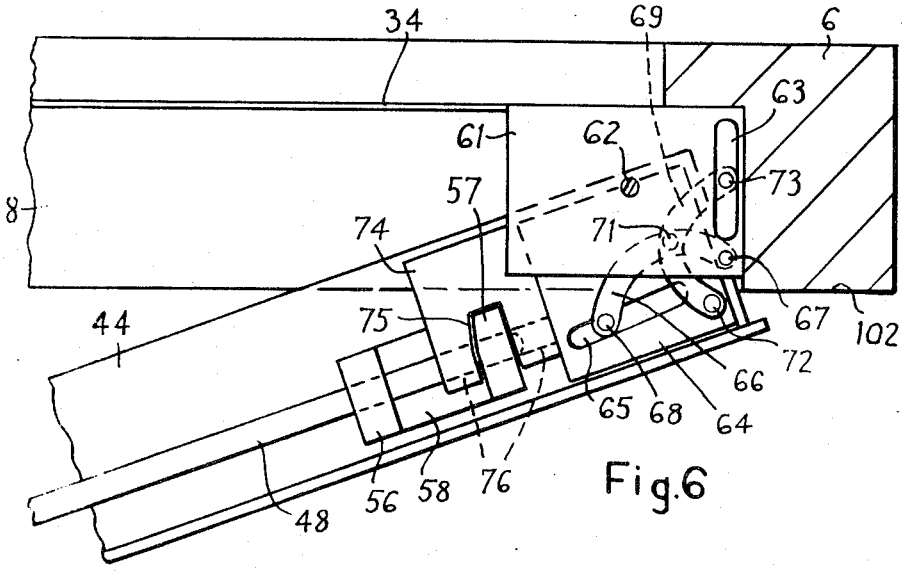
Fig.6

HINGE AND HINGE AND PIVOT ARRANGEMENT

This invention relates to a hinge and to a hinge and pivot arrangement which can employ the said hinge. The hinge and the hinge and pivot arrangement are particularly suitable for use with windows, though the hinge can be used with other hinged members, for example doors, and the hinge and pivot arrangement can be used with other members requiring a hopper opening, for example ventilators.

The hinge can be mounted between a hinged member and a frame in such a way that when the member is closed the hinge is hidden, thereby giving a neat appearance.

The preferred embodiment of the hinge and pivot arrangement, which is particularly suitable for use with windows operated in the known tilt and turn manner, also satisfies the requirement that the mechanism is hidden when the window is closed, is simple to operate and mount and requires a linkage mechanism along two edges of a window sash only.

Accoding to one aspect of the present invention there is provided a hinge which is suitable for use with doors and windows, including a first and a second plate for mounting respectively, when in use, upon a first member and a second member, the second member being moveable relative to the first member, first and second double armed levers pivotally interconnected, the first lever being pivoted about a fixed point on the first plate, the second lever being pivoted about a fixed point on the second plate, and the first and second levers having pins or projecting portions which co-operate with guide portions of the second and first plates respectively, wherein when the hinge is closed the fixed points on the first and second plates overlie one another and the guide portions are not parallel to one another.

According to a further aspect of the invention there is provided a hinge and pivot arrangement for use with a moveable member, for example a window, and a co-operating frame, including an operating mechanism having a first position in which the moveable member is secured to the frame against opening, a second position in which the moveable member can be pivoted about one member of the frame and a third position in which the moveable member can be pivoted about a second member of the frame.

According to yet another aspect of the present invention there is provided a hinge and pivot arrangement for use with a moveable member, for example a window sash, and a co-operating frame, the arrangement including a stay, striker plate, two hinges whereby the moveable member can be hinged about a frame member, and an operating mechanism including a bolt, a pivot arm, a stud and a linkage therebetween, the operating mechanism being for mounting on the moveable member and the striker plate and the stay being for mounting on the frame, wherein in a first position of the operating mechansim the stud engages the striker plate on the frame thereby to secure the moveable member to the frame against opening, in a second position of the operating mechanism the bolt engages one of the two hinges to enable the member to be hinged about the frame member by the said one of the hinges, and in a third position of the operating mechanism the bolt is released from the said one of the two hinges in order to enable the member to pivot about another of the frame members.

Figure 3:
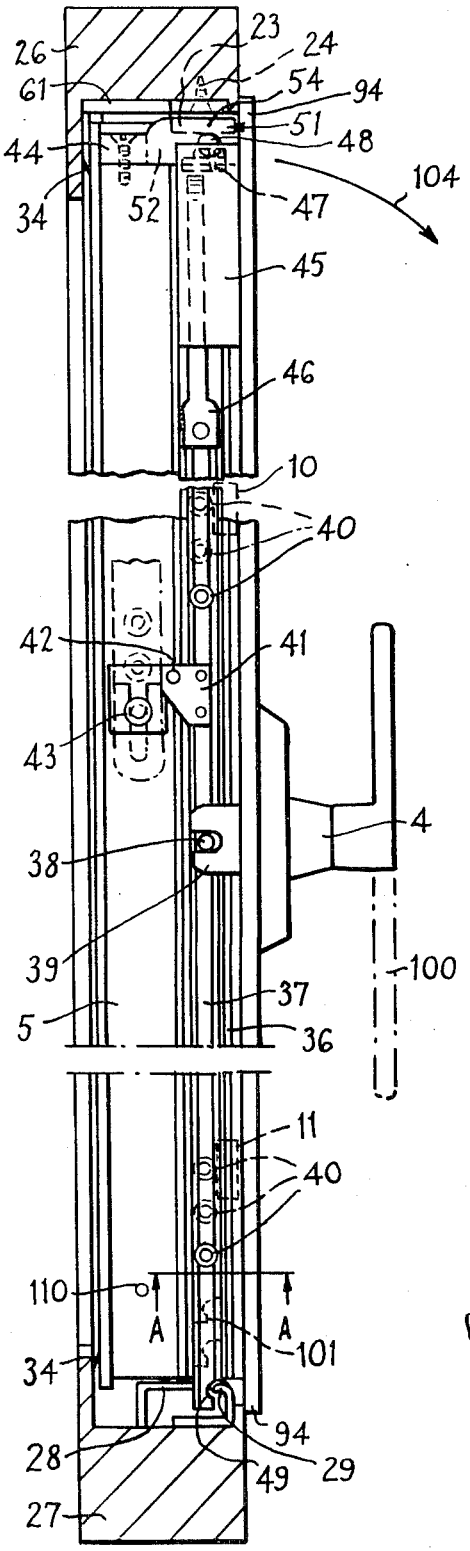
Figure 3A:
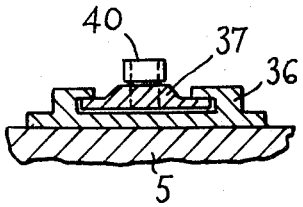
Figure 4:
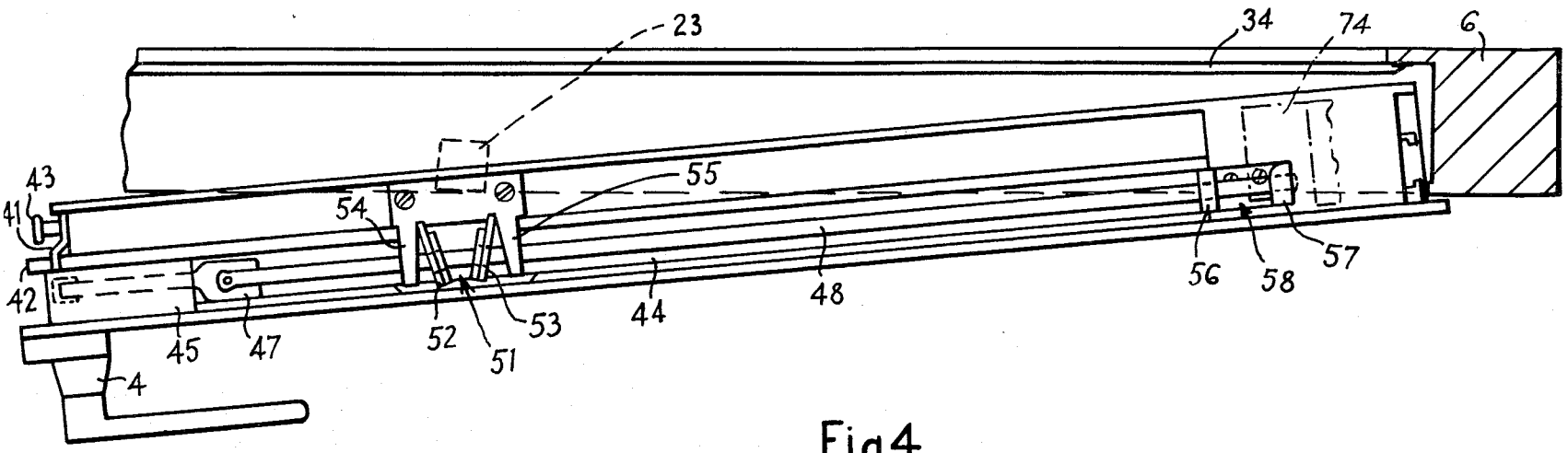
Figure 7:
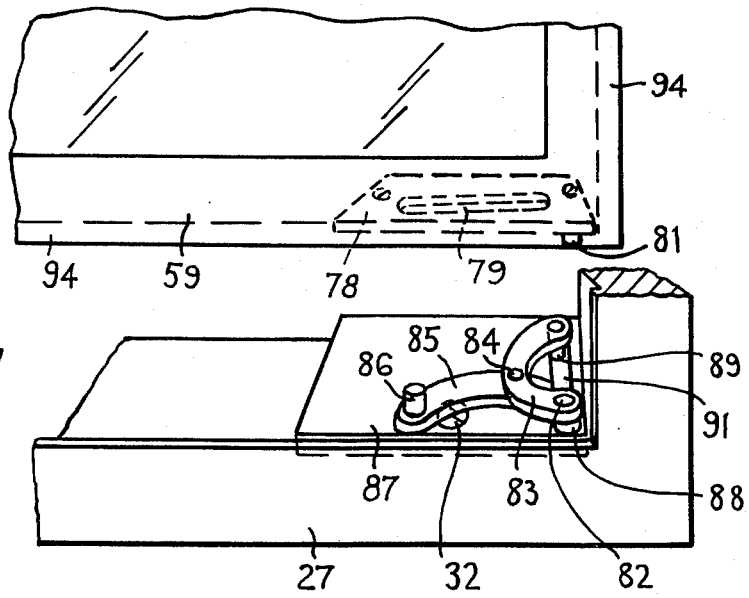
Figure 9:
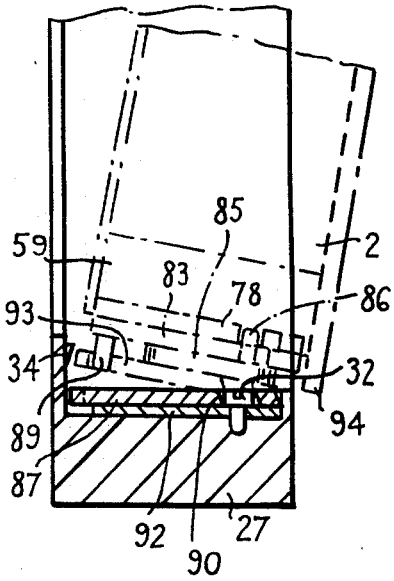
Figure 8:
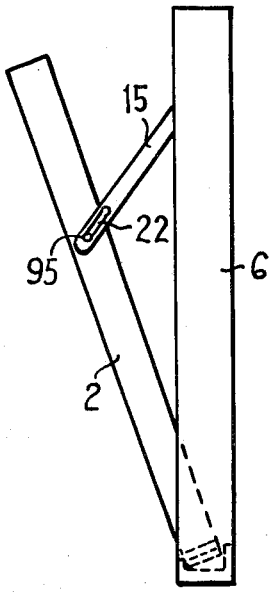

Embodiments of the invention will now be described with reference to the accompanying drawings in which:

FIG. 1 is a diagrammatic perspective illustration of a tilt and turn window to which the invention can be applied, FIG. 2 is a perspective view of a frame within which a window sash can be mounted to operate in the way shown in FIG. 1, FIG. 3 is a side view of the window sash taken from the edge adjacent the operating handle, FIG. 3*a* is a section of an operating rod on the line A—A of FIG. 3, FIG. 4 is a plan view of a window sash shown in relation to the frame, FIGS. 5 and 6 are plan views of a part of the window sash, operating mechanism and the upper hinge parts, FIG. 7 is a diagrammatic perspective view of the lower hinge parts on the sash and the frame, FIG. 8 is a diagrammatic side view of the sash tilted about the frame and FIG. 9 is a diagrammatic section through the hinge of FIG. 7 showing the sash in a tilted position.

Referring to FIG. 1 there is shown a window having a frame 1 within which a sash 2 is secured in the closed position, as indicated by solid lines 3, by the action of rotating a handle 4 so that it extends downwards in line with the stile 5 of the sash 2. With the handle 4 rotated from this position in an anticlockwise direction so that it extends at right angles to the stile 5 of the sash 2, it is possible to turn the sash 2 inwardly about the jamb 6 of the frame 1, as indicated by the dotted line 7. With the handle 4 rotated still further in the anti-clockwise direction so that it extends upwards in line with the stile 5, it is possible to tilt the window sash 2 inwardly about the cill 8 of the frame, as indicated by the dotted lines 9 to provide a ventilating position. The tilt and turn action are well known and enable windows to be tilted inwards about a cill or lower frame member for ventilation and to be turned inwards on hinges about another frame member to enable the outer face of the window to be cleaned easily.

Referring to FIG. 2, the frame 1 is shown with fittings for use with a preferred form of hinge and pivot arrangement according to the present invention.

The fittings include upper and lower striker plates 10 and 11, the upper striker plate 10 incorporating a stay stop 12, mounted on the jamb 13 of the frame. A pair of stays 14, 15 are mounted by plates 16, 17 having back stops 18, 19 on the jambs 13, 6. The stay 14 attached to the jamb 13 carries a channel 21 and the stay 15 mounted on the jamb 6 had a key-hole slot 22. A bolt releasing plate 23 is shown mounted by screws 24, 25 on the head 26 of the frame 1. On the cill 27 of the frame 1, there is mounted a support plate 28 which carries a pivot edge 29, shown more clearly in FIG. 3. The cill 27 of the frame 1 carries a lower hinge plate 31 located by a screw stud 32 about which the plate 31 can tilt. The frame 1 is formed with a recess in which the fittings are mounted between an outer cover strip 33, which covers the junction between the edges of the sash 2 and the frame 1 and carries a weather sealing strip 34, and an inner facing strip 35. The cill 27 of the frame 1 can be provided with drainage channels and holes not shown. It will be noted that in the particular embodiment described, which illustrates a metal window frame, the inner facing strip 35 does not extend so far towards the centre of the frame opening as does the cover strip 33.

Referring to FIG. 3 there is shown the edge of the sash stile 5, upon which the operating handle 4 is mounted, viewed from the jamb 13 of the frame 1 with which it co-operates. The head 26 and the cill 27 of the frame are shown sectioned. A carrier strip 36 is mounted on the edge of the sash stile 5 and carries an operating rod 37 from which a pin 38 extends and engages in a forked member 39 moveable vertically upon the rotation of the handle 4. The relation between the operating rod 37 and the carrier strip 36 is shown more clearly is the cross section on the line A—A of FIG. 3 illustrated in FIG. 3*a*. The operating rod 37 further carries two rollers 40 which co-operate with respective striker plates 10 and 11 indicated by dotted lines and mounted on the jamb 13 of the frame 1.

The operating rod 37 also carries a bracket 41 upon which there is mounted a pin 42 which locates against the stay 14 in the closed position of the sash and a headed pin 43 which engages the channel 21 in the stay 14. The pins 42 and 43 are better seen from FIG. 4. The movement of the operating rod 37 is transmitted around the corner of the sash between the edge of the sash stile 5 visible in FIG. 3 and the upper edge of the upper rail 44 of the sash 2 by a flexible transmission system shwon diagrammatically at 45 which can be of the Bowden cable or chain-link type, mounted within a casing and attached to the rod 37 by a link 46. The other end of this flexible corner transmission system is shown in FIG. 4 attached by a link 47 to a bolt 48. The end of the operating rod 37 remote from the corner transmission system is formed with a recess 49 which co-operates wih the pivot edge 29 on the support plate 28. The bolt 48 shown in FIG. 4 passes through a locking mechanism 51 which is mounted on the edge of the upper rail 44 of the sash and includes two apertured members 52, 53 which are sprung towards one another and two relatively fixed apertured members 54, 55. The locking mechanism 51 co-operates with the plate 23 on the head 26 of the frame. The end of the bolt 48 passes through holes in the two arms 56, 57 of a U-shaped member 58 mounted on the upper rail 44 of the sash.

The sash 2 is hung to turn about the frame 1 by means of hinge arrangements between the upper rail 44 of the sash 2 and the head 26 of the frame 1 and between the lower rail 59 of the sash 2 and the cill 27 of the frame 1.

The hinge arrangement between the upper rail 44 of the sash 2 and the head 26 of the frame 1 can be seen most clearly in FIGS. 5 and 6 and includes a plate 61 attached to the head 26 of the frame 1 by means of a screw passing through a hole 62. The plate 61 has a guide slot portion 63. A second plate 64, with a guide slot portion 65, is attached by a linkage to the first plate 61. The linkage includes a first double armed lever 66 which is attached at one end to the first plate 61 at a fixed pivot point 67. The other end of the lever 66 carries a pin 68 which runs in the guide slot 65 in the plate 64. The first lever 66 is attached to a second double armed lever 69 by a pivot 71 and the second double armed lever 69 is attached at one end to the second plate 64 at a fixed pivot point 72. The other end of the second double armed lever 69 carries a pin 73 which runs in the guide slot 63 in the first plate 61. The second plate 64 is attached to a block 74 in which there is a slot 75 on either side of which a hole 76 extends. In the closed position of the window, shown in FIG. 5, the holes in the arms 56, 57 of the U-shaped member 58 and the hole 76 in the block 74 are in line and the arm 57 is within the slot 75 in such a position that the bolt 48 can pass through the holes in the arms 56 and 57 and the hole 76 to couple the member 58 to the block 74.

The hinge between the lower rail 59 of the sash 2 and the cill 27 of the frame 1 is shown in FIG. 7 and includes a first plate 78 screwed to the lower rail 59 of the sash 2. The plate 78 has a slot 79 and a downwardly extending pin 81. the pin 81 engages with a hole 82 in one end of a first double armed lever 83 which is attached by a pivot 84 to a second double armed lever 85 from which there extends a pin 86 which co-operates with the slot 79 in the first plate 78. A second plate 87 is located on the cill 27, as may be more clearly seen in FIG. 9, by the screw stud 32 which extends above a base plate 92 and which secures the base plate 92 to the cill 27. The second lever 85 is attached to the second plate 87 at a fixed pivot point 88. The first lever 83 carries a pin 89 which co-operates with a slot 91 in the second plate 87. The second plate 87 has a hole 90 which is of larger diameter than that of the screw stud 32, thereby allowing the second plate 87 to tilt around the stud 32 in the way indicated in FIG. 9 to the position indicated by the dotted lines 93.

The actions of the upper and lower hinge arrangements are similar. It will be noted that the sash 2 has a lip 94 on all four edges which covers any gap between the sash and the frame and gives the window a neat appearance.

FIG. 8 shows the sash tilted inwards from the top with a fixed stud 95 on the sash stile adjacent the jamb 6 engaged with the keyhole slot 22 in the stay 15.

Considering the operation of the mechanism controlled by handle 4, it will be understood that, with the handle 4 in the downward pointing direction shown in dotted lines at 100 in FIG. 3, the forked member 39 will be moved to a maximum extent towards the head 26 of the frame. This action will move the rod 37 via the pin 38 in the same direction, raising the end of the rod 37 near to the cill 27 to the position indicated in dotted lines at 101. At the same time the rollers 40 carried by the rod 37 wil be moved behind the striker plates 10 and 11 on the jamb 13 thereby securing the window in the closed position in the frame 1. This movment of the rod will also be transmitted via the links 46 and 47 and the flexible transmission system within the casing 45 to the bolt 48 mounted on the upper rail 44 of the sash 2. The bolt 48 will be caused, by this action, to pass from the position shown in FIG. 5 through the hole in the arm 57 on the U-shaped member 58 and the hole 76 in the block 74 attached to the plate 64 of the upper hinge arrangement to its maximum possible extent.

By rotating the handle 4 through an angle of 90° in the anticlockwise direction from the position shown at 100 in FIG. 3 to the position shown on the sash indicated by dotted lines 4 in FIG. 1, the rollers 40 are caused to move towards the cill 27 and to be disengaged from the striker plates 10 and 11. The movement of the rod 37 carrying the rollers 40 due to this rotation of the handle is not, however, sufficient to cause the pivot arm consituted by the rod 37 to engage the pivot edge 29 on the support plate 28. This rotation of the handle also causes the bolt 48 to be withdrawn to the position shown in FIG. 6, thereby maintaining the U-shaped member 58 on the sash secured to the block 74 which is attached to the head 26 of the frame via the upper hinge arrangement. With the rollers 40 disengaged from the striker plates 10 and 11 and the upper rail 44 of the sash engaged with the hinge arrangement attached to the head 26 of the frame, it is possible to turn the window sash 2 about the jamb 6 upon the upper and lower hinge arrangements

As has been explained, the operation of the two hinge arrangements is similar and their operation will now be described with reference to the upper hinge. It can be seen from FIG. 5 that in the closed position of the sash, the guide slots 63 and 65 are substantially at right angles to one another and the fixed pivots 67 and 72 overlie one another. In turning the sash inwards about the jamb 6, the action of the hinge arrangements is such that, in addition to a rotation about the jamb 6, the sash is allowed to move away from the frame and is rotated through an angle of almost 180°. The locus of the pivot 72 of the upper hinge, which is fixed in relation to the sash 2, is, during this turning movement, a curve which moves from overlying the fixed pivot 67 on the head 26 of the frame to a point near the inner face 102 of the jamb 6. The action is controlled by the movement of the pins 68 and 73 in the guide slots 65 and 63 and by the pivoting actions of the first and second levers 66 and 69 about their common pivot 71.

The bolt 48 is allowed to move and the handle 4 is allowed to rotate only when the sash 2 is in the closed position in the frame, by virtue of the fact that the plate 23 attached to the head 26 of the frame engages the sprung members 52 and 53 and forces them away from one another only when the sash and the frame are in these relative positions. The forcing of the members 52 and 53 away from one another provides a free passage for the bolt through the holes in these members and in the arms 54 and 55. The locking action can be seen quite clearly from FIG. 4, where the sash is turned about the hinge arrangement (not shown) to disengage the members 52 and 53 from the plate 23. The spring members 52 and 53 are thereby enabled to engage the bolt 48 and lock it against longitudinal movement in either direction. If necessary raised portions or notches can be provided on the bolt 48 to ensure a better engagement between the bolt 48 and the members 52 and 53. It will be understood that any attempt to move the bolt towards the jamb 6 when the members 52 and 53 are free will cause the member 52 to bind more firmly on the bolt 48. Any attempt to move the bolt 48 in the other direction when the members 52 and 53 are not restrained by the plate 23 will cause the member 53 to bind on the bolt 48 and to lock it in position. It will therefore be understood that, when the sash is either tilted or turned so that the plate 23 does not engage the members 52 and 53, it is impossible to rotate the handle 4 and move the operating mechanism. However with the sash closed in the window frame the handle 4 and the operating mechanism may be moved to any position.

With the handle 4 moved into the upwardly extending position shown in solid lines in FIG. 3 with the sash closed in the frame, the operating rod 37 is moved downwards to act as a pivot arm so that the recess 49 is enabled to engage the pivot edge 29 of the plae 28. In this position th rollers 40 are, of course, well spaced from the striker plates 10 and 11 and the bracket 41, carried on the operating rod 37, is moved downwards so that the pin 43, shown best in FIG. 4, engages the channel 21 in the stay 14 shown in FIG. 2. As mentioned, this operation takes place with the sash in the closed position and, in this position, the stud 95 (FIG. 8) on the sash 2 engages the hole at the head of the keyhole slot 22 in the stay 15, shown in FIG. 2. The movement of the rod 37 is transmitted to the bolt 48 through the corner transmission system 45 housed in the casing and the bolt 48 is withdrawn from engagement with the block 74 to the position shown in FIG. 5. The sash is thereby freed from the upper hinge arrangement, and any attempt to turn the sash about the jamb 6 is frustrated by the rod 37 extending behind the pivot edge 29 on the plate 28. However, with the upper rail 44 of the sash freed from connection with the frame it is possible to tilt the window sash in the direction of the arrows 103 in FIG. 5 and arrow 104 in FIG. 3 about the cill 27 of the frame. This action causes the neck of the stud 95 to pass down the key hole slot 22 in the stay 15 and the neck of the headed stud 43 to pass down the channel 21 in the stay 14 thereby causing the stays to extend to the positions shown in FIG. 8 and locate the sash in an inwardly tilted position. The pivot points for the sash to tilt about the cill 27 are provided by the flat upper surface of the support plate 28 and by the base plate 92 about which the second plate 87 of the lower hinge arrangement tilts, as shown in FIG. 9, to the position indicated by the dotted lines 93. The tilting of the plate 87 is made possible by the relation between the shape of the stud 32 and that of the side wall of the hole 90. The recess 49 and the pivot edge 29 are to some extent hook shaped so that the rod 37 engages upon and beneath the pivot edge 29 thereby making it difficult to lift the sash out of the frame when the operating mechanism is in position for the tilting action.

It will be appreciated that, although the rod 37 contitutes a pivot arm engaging the pivot edge 29, the action between the rod 37 and the edge 29 is in the nature of a retaining action. The actual pivot points are, as mentioned above, between the support plate 28 and the base plate 92 and the sash.

Before the bolt 48 is withdrawn from engagement with the hole 76 in the block 74, it is necessary for the pivot arm constituted by the rod 37 to be in a position to engage the pivot edge 29, otherwise it would be possible for the window to be mis-operated by rotating the handle 4 when the window sash was in the closed position to an intermediate position in which neither the pivot arm on the sash was engaged with the edge 29 on the frame nor the bolt 48 on the sash was engaged with a part of the upper hinge arrangement on the frame. If such a condition were allowed to exist it would be possible for the sash to come out of the frame accidentally.

Although the invention has been described with reference to a particular embodiment it will be appreciated that variations and modifications can be made within the scope of the invention. For example, the operating mechanism for securing the window and changing its function between tilting and turning actions can be employed with other hinge arrangements than those described. Furthermore it is not necessary for the turning action to operate in the manner of a side hung window and the tilting action to be between the bottom rail of the sash and the cill. For example, the turning action could be provided in the manner of a top hung window and the tilting action could take place about a jamb of the frame. Other types of locking mechanism than that shown at 51 in FIG. 4 could be used and the handle 4 could incorporate a safety plunger which it would be necessary to operate before the horizontal position of the handle 4 could be engaged from either direction, thereby making accidental engagement of the turning position virtually impossible. The apparatus described can be applied to either wooden or metal windows with minor modifications.

In place of or in addition to the pivot arm constituted by the rod 37 cooperating with the pivot edge 29, a pin 110 extends from the lower edge of the stile 5, shown in FIG. 3, to cooperate with the shoulder 111 of a bracket 112 attached to the jamb 13 of the frame, shown in FIG. 2. With the sash in the closed position the pin 110 passes beneath the shoulder 111 and in the tilted position the pin 110 locates beneath the shoulder 111 to reduce the risk of the sash being accidentally lifted out of the frame.

The hinge arrangement shown enables the sash to be turned through approximately 180° when being operated in the side hung manner. The hinges are mounted on the cill and the head of the frame without any cutting of the frame and they do not extend into the jamb of the frame in any way.

Instead of using flat mounting plates in the hinges in which guide slots are made and mounting the plates on the heads and cills of frames and the rails of sashes, the mountings for the hinges can be on a jamb of a frame and a stile of the sash and consist of members having guide channels in their upper edges and which extend depthwise of the mounting as it is on the jamb and the stile, instead of guide slots passing through their thickness.

I claim:

1. A hinge and pivot arrangement for a movable member, for example a window sash, and a co-operating frame, the arrangement including two hinges arranged at opposite ends of one member of the frame whereby the movable member can be hinged about said one frame member, a bolt co-operating with means for releasably connecting one of said hinges to the movable member, at least one striker plate on another member of the frame, opposite to the said one frame member, a stay pivoted at one end to said another frame member, and an operating mechanism mounted on the movable member and including an operating handle, an operating rod movable by the handle and carrying a locking member and a pin engagable in a channel in the free end of the stay and a linkage connecting the bolt and the operating rod, wherein in a first position of the operating handle, the locking member engages the striker plate thereby to secure the movable member to the frame against opening, in a second position of the operating handle, the locking member is disengaged from the striker plate and the bolt and co-operating means connect the said one of the hinges to the movable member whereby the movable member can turn about both hinges, and in a third position of the operating handle, the locking member is disengaged from the striker plate and the bolt and co-operating means disconnect the hinge from the movable member and the pin is engaged in the channel of the stay whereby the movable member can tilt within the limit imposed by the stay relative to a further member of the frame which interconnects the said opposing frame members.

2. A hinge and pivot arrangement as claimed in claim 1, wherein the said one hinge comprises a first plate and a second plate mounted and fixed respectively upon a member of the frame opposite to the further frame member and interconnecting said one and another opposed frame members and to a member of the co-operating means, first and second double armed levers pivotally interconnected, the first lever being pivoted about a fixed point on the first plate, the second lever being pivoted about a fixed point on the second plate, and the first and second levers having pins or projecting portions which co-operate with guide portions of the second and first plates respectively, whereby when the hinge is closed the fixed points on the first and second plates overlie one another and the guide portions are not parallel to one another.

3. A hinge and pivot arrangement as claimed in claim 1, wherein a locking mechanism is provided for preventing operation of the operating handle when the movable member is open by locking the bolt against movement relative to the movable member, the locking mechanism being mounted on the movable member and co-operating with a releasing member on the frame to release the bolt and thus the operating handle only when the movable member is closed.

4. A hinge and pivot arrangement as claimed in claim 1, wherein the other hinge comprises a plate which is located on the said further frame member by a screw member extending through a hole in the plate, which is of larger diameter than that of the screw member, and wherein the operating rod has a free end provided with a recess which in the third position of the operating handle engages a pivot edge on the said further frame member, whereby in the third position of the operating handle, the movable member can tilt about the screw member and pivot edge.

5. A hinge and pivot arrangement as claimed in claim 1, wherein a second stay is pivoted at one end to the said one frame member and a stud on the movable member engages a slot in the free end of the second stay when the movable member is closed, whereby when the operating handle is in the third position and the movable member is tilted relative to the further frame member the stud slides along the slot in the second stay.

6. A hinge and pivot arrangement as claimed in claim 1, wherein a pin projects from the movable member, and co-operates with a retaining member mounted on said another frame member, whereby when the movable member is tilted the pin locates beneath the retaining member to guard against the movable member from being lifted out of the frame.

* * * * *